United States Patent [19]

Nordgren

[11] 4,051,786

[45] Oct. 4, 1977

[54] LOADING PALLET

[76] Inventor: Hans-Elov Nordgren, Runemo S-822 00, Alfta, Sweden

[21] Appl. No.: 589,630

[22] Filed: June 23, 1975

[51] Int. Cl.[2] ..... B65D 19/40

[52] U.S. Cl. ..... 108/51.1; 108/56.3; 248/188; 403/230; 403/406

[58] Field of Search ..... 108/51–58, 108/150; 206/386; 217/43 A; 52/219, 753 L, 751, 752, 753 C; 248/56, 57, 188, 188.8, 216, 300, 221 B, 221 F; 85/13; 229/49; 403/230, 232, 262, 406; 29/432; 113/116 FF

[56] References Cited

U.S. PATENT DOCUMENTS

| | | | |
|---|---|---|---|
| 520,430 | 5/1894 | Hoggson | 108/150 UX |
| 1,842,617 | 1/1932 | Lupton | 108/51.1 |
| 2,206,918 | 7/1940 | Powell | 229/49 |
| 2,396,030 | 3/1946 | Terry | 85/13 X |
| 2,691,499 | 10/1954 | Watts | 108/56 |
| 2,769,650 | 11/1956 | Larson | 248/188 X |
| 2,888,221 | 5/1959 | Connelly | 108/56 |
| 2,996,237 | 8/1961 | Hines | 229/49 |
| 3,066,992 | 12/1962 | Larson | 248/188 |
| 3,454,292 | 7/1969 | Sanford | 52/753 L |
| 3,601,428 | 8/1971 | Gilb | 52/751 |
| 3,641,948 | 2/1972 | Brown | 108/51 |
| 3,683,738 | 8/1972 | Kyriakos | 85/13 |
| 3,835,791 | 9/1974 | Brown | 108/51 |

FOREIGN PATENT DOCUMENTS

| | | | |
|---|---|---|---|
| 683,104 | 4/1964 | Canada | 403/232 |

*Primary Examiner*—Roy D. Frazier
*Assistant Examiner*—William E. Lyddane
*Attorney, Agent, or Firm*—Diller, Brown, Ramik & Wight

[57] ABSTRACT

The present invention is related to a product, especially a loading pallet, comprising a sheet-like or flat part and one or more projections or spacing members attached thereto, each member being attached to the sheet part by means of a mounting having an angle-shaped cross-section, wherein one flange of the mounting is surrounding perimeterally or peripherally an end portion of the spacing member and attached thereto by a first series of anchor tabs extending inwardly from the flange and forced to penetrate into the surface of the spacing member, while the other flange of the mounting is abutted against a surface of the sheet part and attached to the sheet part by means of a second series of anchor tabs projecting from that surface of the flange which is directed away from the spacing member and penetrated into the surface of the sheet part, said second flange being slotted or cut at adequate locations so as to permit the perimeteral or peripheral surrounding of the spacing member by the first flange.

1 Claim, 5 Drawing Figures

LOADING PALLET

This invention refers to a product, especially a loading pallet, comprising at least one sheet-like or plane part and one or more projections or spacing members attached thereto, each member being attached to the sheet part by means of a mounting or fitting having an angle-shaped cross-section.

The object of the invention is to make the production of such products more effective and cheaper, particularly in respect of the attachment of the spacing members or projections to the sheet part in a reliable and material saving manner without breaking through the sheet part which is left completely flat and solid.

In accordance with the principle of the invention this is achieved in that one flange of the mounting is provided to surround perimeterally or peripherally an end portion of the spacing member and attached thereto by a first series of anchor tabs known per se or arbitrary, said tabs extending inwardly from the flange and penetrating into the surface of the spacing member, while the other flange of the mounting is abutted against a surface of the sheet part and joined to the sheet part by means of a second series of anchor tabs projecting from that surface of the flange which is directed away from the spacing member and penetrating into said surface of the sheet part, said second flange being slotted or ruptured at adequate locations so as to permit the first flange to perimeterally or peripherally surround the spacing member.

The invention is particularly advantageous in connection with loading pallets comprising a load-carrying rectangular sheet and at least four spacing members suitably placed at the corners of the sheet and permitting the forks of a lifting truck to be inserted under the sheet. Nevertheless the invention is just as well applicable in connection with other products such as transport containers, to the underside of which an appropriate number of spacing members are attached.

When a sheet part and spacing members respectively are mentioned here in connection with the invention, these definitions should be understood in their very broadest sense. Thus the sheet part may be assembled in an arbitrary manner from a plurality of elements which together form a sheetlike part or at least a part presenting more or less flat surfaces to which the spacing members are attached. The spacing members may have any suitable shape whatsoever, although a type to be described hereinafter is to be preferred.

Beyond the product as such the invention also relates to a method for making the product. The features of this method are defined in the subsequent claims.

With reference to the accompanying drawings a closer description of an embodiment of the invention, as an example, will follow.

Figure 1:
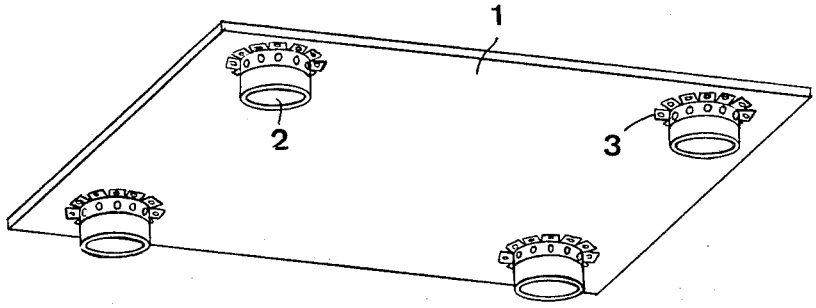
FIG. 1 is a perspective view, seen obliquely from below, of a loading pallet made according to the invention, four spacing members being attached to the underside of a sheet part.

In FIG. 1 designation 1 indicates a sheet-like or flat part to which a number of projections or spacing members 2 are attached. In the embodiment shown, the number of spacing members is four. The attachment of the spacing members 2 to the sheet part 1 is performed by means of mountings 3. The design of the mounting is best seen in FIGS. 2 to 5 which reference is made now.

The mounting 3 is angle-shaped, suitably L-shaped, in cross-section and has arbitrary anchoring tabs 4 and 5. One flange 6 of the mounting extends peripherally or perimeterally around the spacing member 2 and is joined thereto by the anchor tabs 5. The other flange 7 of the mounting is abutting against the sheet part 1 and attached thereto by the anchor tabs 4. The second flange 7 is slotted or cut at adequate locations so as to permit the peripheral close attachment of the first flange 6 to the spacing member 2.

In the example shown, the spacing member 2 is circular in cross-section, hence the first flange 6 in the applied condition also presents a circular shape. In order to permit the first flange 6 to adopt a circular shape, the second flange 7 has a plurality of spaced, suitably evenly spaced slots or notches 8 extending radially outwardly from the first flange 6. In practice, the distances between the individual notches 8 may be equal to or possibly smaller than the width of the flange 7. If the width of the flange 7 as an example is 20 millimeters, the distance between adjacent notches consequently may be within the range of 10 to 20 millimeters.

The length of the mounting 3 is suitably equal to the circumference of the spacing member. Nevertheless it is conceivable to attach, along the periphery, two or more mountings having lengths smaller than the circumference of the spacing member.

According to a preferred embodiment of the invention the spacing members 2 are made of paper board and are shaped as cylindrical tubes as illustrated in the drawings. Such spacing members may be made extraordinarily cheap by cutting off the cores in conventional paper-rolls. Such cores are normally discarded as rejects.

The production of the product according to the invention proceeds in the following way. In a preparatory step the mounting 3 is formed. A flat band-shaped plate blank is provided, in a manner known per se, with two series of anchor tabs 4 and 5 by die-cutting which may be performed simultaneously with cutting notches 8 in the plate. Furthermore, the plate blank is bent so as to achieve the angle-shaped or L-shaped section profile. This profile fashioning can be performed either before or after the cutting of the anchor tabs and the notches, respectively. The plate is cut in lengths adopted to the circumference of the spacing members 2.

Figure 2:
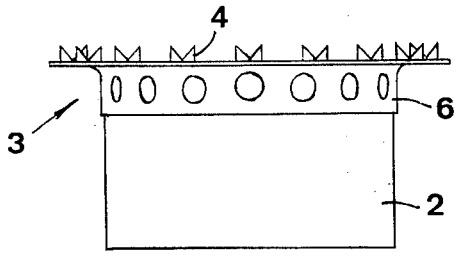
FIG. 2 is a side elevation of a spacing member with the mounting according to the invention, a first method step of the invention being illustrated.
Figure 3:
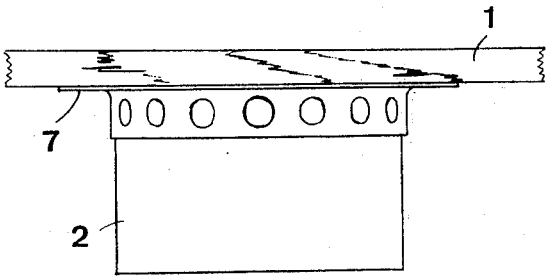
FIG. 3 is a similar side elevation illustrating a second method step of the invention.
Figure 4:
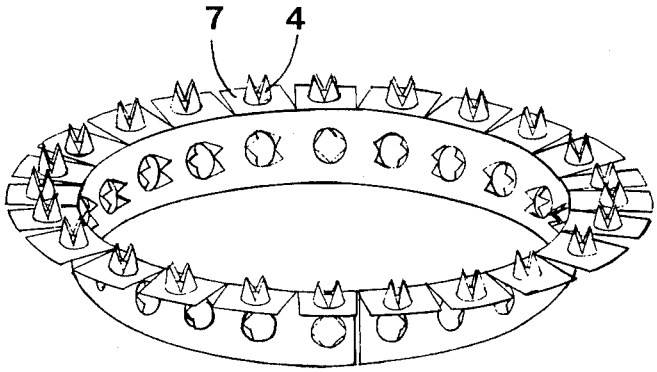
FIGS. 4 and 5 are perspective views of the mounting according to the invention seen obliquely from above and obliquely from below, respectively.
Figure 5:
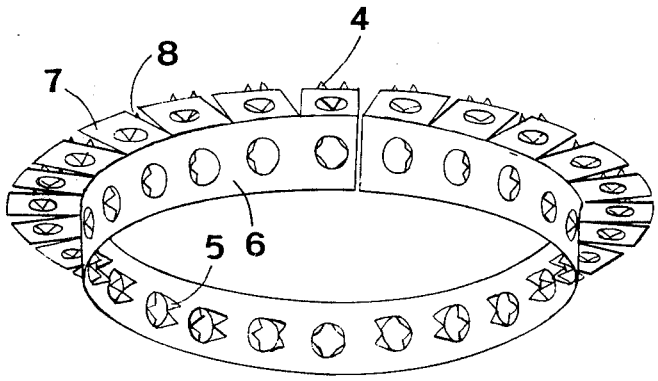

When the mounting thus has been made, it is, in a first step, attached to the spacing member 2, the attachment of the first flange 6 of the mounting being performed by rolling it onto the spacing member in a roller apparatus designed particularly for this purpose. When the mounting 3 has, as shown in FIG. 2, been attached to the spacing member 2, the mounting is, in a second step, illustrated in FIG. 3, abutted against the sheet part and the second flange 7 of the mounting is joined to the sheet part by pressing the anchor tabs 4 into the sheet part. This pressing of the second flange 7 may be performed by an annular pressing means designed particularly for this purpose.

The advantages of the invention are obvious, since the product, particularly loading pallets, can be produced extraordinarily cheap and rational. Thus it has been found that a loading pallet according to the invention can be produced at a cost amounting to only about ⅓ of the cost of a conventional loading pallet; thus it is economically justified to use the new pallet as a non-return pallet.

The invention is not limited merely to the embodiment described and shown here. Thus it is for instance possible to use, instead of spacing members having a completely circular cross-sectional shape, spacing members having any other geometric shape, e.g., square or rectangular cross-section. Possibly, the spacing members may have only partially circular or short arched portions alternating with straight portions. Also the dimensions and the shape of the mounting 3 as well as of the sheet part 1 may vary very considerably without departing from the idea of the invention as defined in the claims.

What is claimed is:

1. A support comprising a sheet-like member defining a supporting surface, a plurality of supports underlying said sheet-like member, and a securing member individually securing each support to said sheet-like member, each support being generally circular in peripheral outline, and each securing member formed of readily bendable sheet metal and including a one-piece tubular portion wrapped substantially entirely around a respective support at one end and a flanged portion secured to said sheet-like member, said tubular portion having a plurality of integrally preformed securing elements extending radially into said support for the full depth of said securing elements beginning at their lines of connection with said tubular portion, and said flanged portion including a plurality of segments separately connected to said tubular portion thereby permitting wrapping of said tubular portion about said support, and each segment having at least one integrally formed securing element projecting therefrom into said sheet-like member.

* * * * *